US005330400A

United States Patent [19]

Huberman

[11] Patent Number: 5,330,400

[45] Date of Patent: Jul. 19, 1994

[54] CLIMBING AND PLAY STRUCTURE

[76] Inventor: Joseph G. Huberman, 904 Dorothea Dr., Raleigh, N.C. 27603

[21] Appl. No.: 52,102

[22] Filed: Apr. 22, 1993

[51] Int. Cl.[5] ..... A63B 17/00

[52] U.S. Cl. ..... 482/35; 482/121

[58] Field of Search ..... 482/35-37, 482/121-129; 446/901

[56] References Cited

U.S. PATENT DOCUMENTS

| | | | |
|---|---|---|---|
| 2,843,379 | 7/1958 | Merritt | 482/36 X |
| 3,008,711 | 11/1961 | Dillon . | |
| 3,547,435 | 12/1970 | Scott | 482/37 X |
| 3,719,358 | 3/1973 | Aaron | 482/36 |
| 3,970,301 | 7/1976 | Lehman . | |
| 3,974,611 | 8/1976 | Satterthwaite | 482/35 |
| 4,116,433 | 9/1978 | Koerner | 482/35 X |
| 4,796,884 | 1/1989 | Ely et al. | 482/35 |
| 5,070,665 | 12/1991 | Marrin et al. | 446/901 X |
| 5,167,595 | 12/1992 | Gleeson et al. | 482/35 |

FOREIGN PATENT DOCUMENTS

| | | | |
|---|---|---|---|
| 1812593 | 1/1978 | Fed. Rep. of Germany | 482/35 |
| 2310787 | 12/1976 | France | 482/35 |

OTHER PUBLICATIONS

The "Yard Playhouse" In *Popular Mechanics*, Jun. 1981, p. 135.

*Primary Examiner*—Robert Bahr
*Attorney, Agent, or Firm*—Olive & Olive

[57] ABSTRACT

A climbing and play structure having an external rigid polyhedral support structure constructed of rigid compressive members, which acts as an exterior support for a network of primary and secondary tensile members, such as rope-like materials and flexible planar surfaces which may be within and on the surface of the structure.

15 Claims, 7 Drawing Sheets

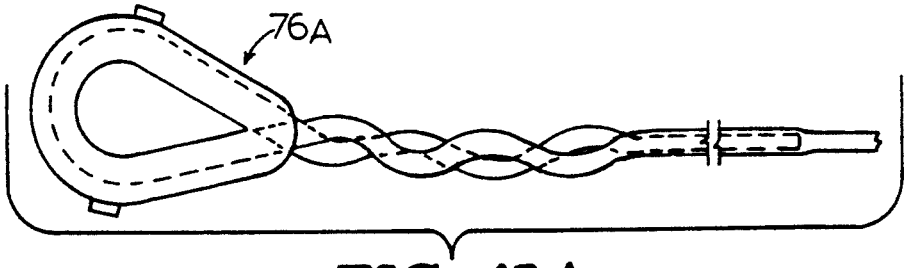
FIG. 12A
FIG. 12B
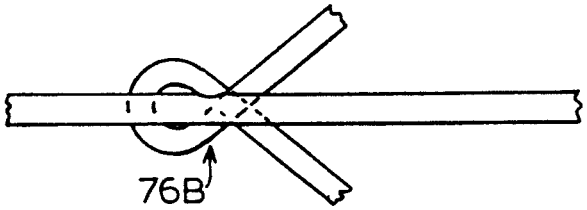
FIG. 12C
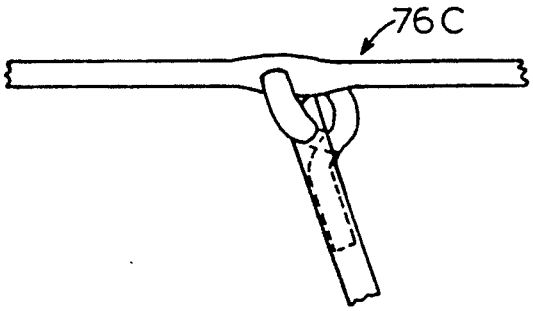
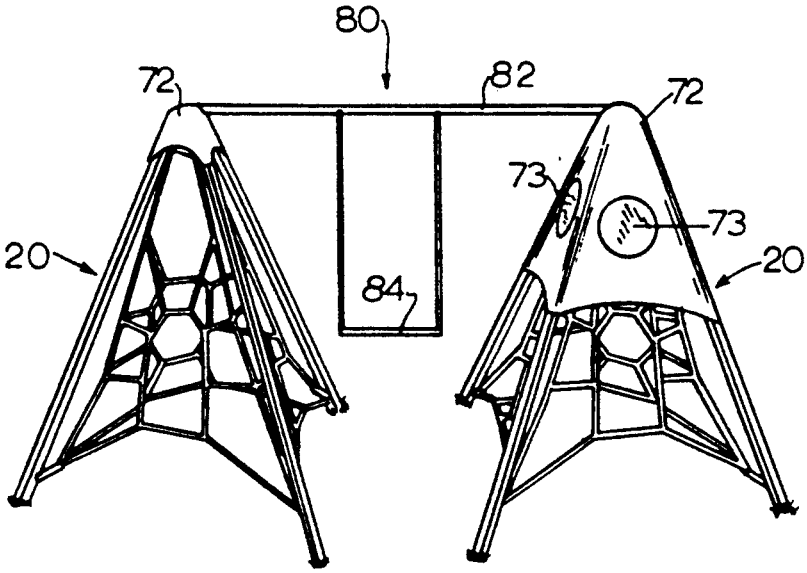
FIG. 13

CLIMBING AND PLAY STRUCTURE

BACKGROUND OF THE INVENTION

1. Field of the Invention

This invention relates to climbing and play structures, and in particular relates to a rope and fabric network for children.

2. Description of the Related Art

Numerous climbing and play structures have been developed for children. Many of these are made of rigid materials. Such "Jungle Gym" structures made of pipe and other rigid materials exist in many forms and are popular with children. For example, the structure of U.S. Pat. No. 1,901,964 has a firepole in its center, the structure of U.S. Pat. No. 2,648,539 has a generally round form, and that of U.S. Pat. No. 2,886,317 is in the form of a turtle. Such structures may present a hazard because they are made of rigid materials. A child losing its grip on an upper bar may fall on to a lower rigid bar. Assembly may also be difficult.

Children's play structures may also enclose space having walls and platforms. See, for example, U.S. Pat. Nos. 3,931,941 and 3,925,941 which describe structures formed of surface sheets making up modules that enclose spaces. These modules can be interconnected to form multi-room houses, but do not provide climbing opportunities.

Ropes and rope-like materials have also been used in climbing and play structures. The device of Dillon (U.S. Pat. No. 3,008,711) consists of a rope grid forming an A-frame of rectangular planes and has a rope grid floor. The rope apparatus of Toman (U.S. Pat. No. 3,794,316) is a support for a gymnastic apparatus, and comprises a net that encloses and defines a climbing playspace for children. The network of Lehman (U.S. Pat. No. 3,970,301) has doubly-curved faces on an inner net projecting inward from an outer net in the form of polyhedral and polygonal curved edges and doubly-curved faces. The complex form of the double net system divides the inner space, and thus requires that the structure be quite large if children are to be able to move comfortably and not be entrapped.

It is therefore an object of this invention to provide a climbing and play structure which has multiple net surfaces but has an open space in the interior which is free from structural ropes. This provides space for play, and allows the structure to be constructed to fit in small spaces.

It is a further object of this invention to provide a climbing and play structure which is sturdy, but does not have inner rigid members.

It is a further object of this invention to provide a climbing and play structure which is composed of flexible tension members and which can be easily assembled.

It is a further object of this invention to provide a climbing and play structure which includes both rope climbing members and planar surfaces.

Other objects and advantages will be more fully apparent from the following disclosure and appended claims.

SUMMARY OF THE INVENTION

The climbing and play structure of the invention comprises a rigid polyhedral support structure, preferably a tetrahedron, constructed of rigid compressive members. The polyhedral structure acts as an exterior support for inner networks of primary and secondary tensile members which are comprised of rope-like materials, and for flexible planar surfaces which may be within and on the surface of the structure. The structure thus provides climbing and bouncing opportunities for children.

Other aspects and features of the invention will be more fully apparent from the following disclosure and appended claims.

BRIEF DESCRIPTION OF THE DRAWINGS

FIG. 12 (A,B,C) is a perspective view of three means of connection of tensile members to each other.

FIG. 13 is a perspective view of multiple structures attached by means of an upper beam.

DETAILED DESCRIPTION OF THE INVENTION AND PREFERRED EMBODIMENTS THEREOF

Figure 1:
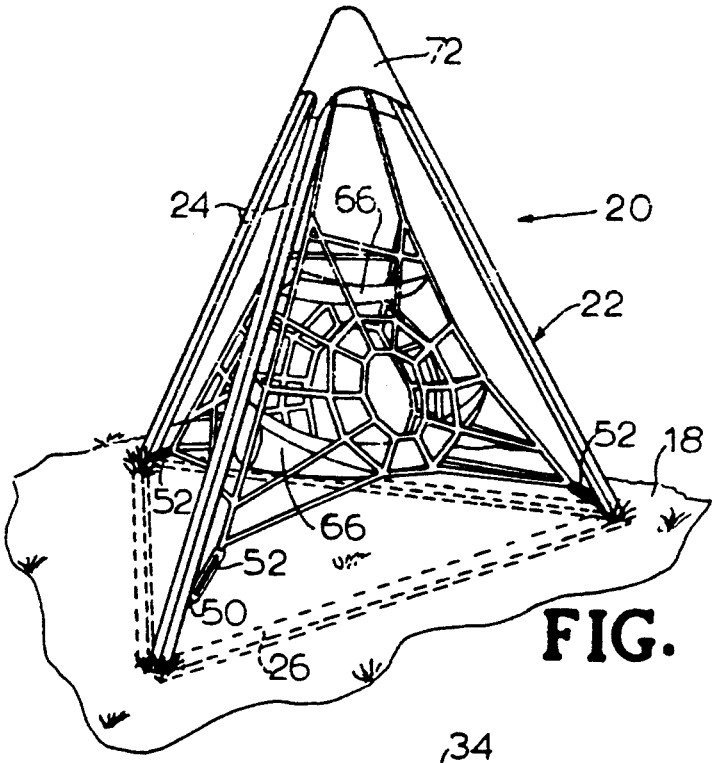
FIG. 1 is a perspective view of the present invention.
Figure 2:
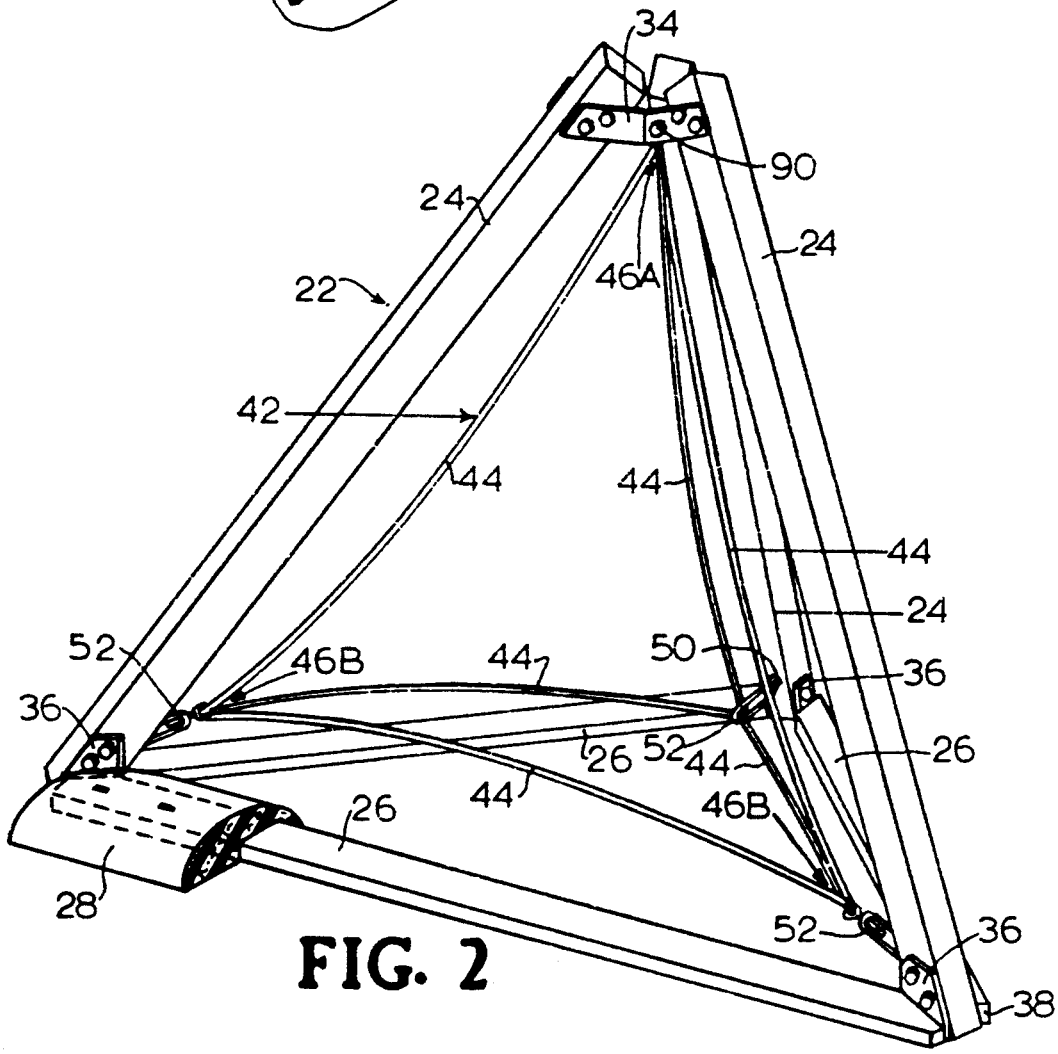
FIG. 2 is a perspective view of the compressive beams and primary inner network of a tetrahedral structure of the preferred embodiment of the invention.
Figure 3:
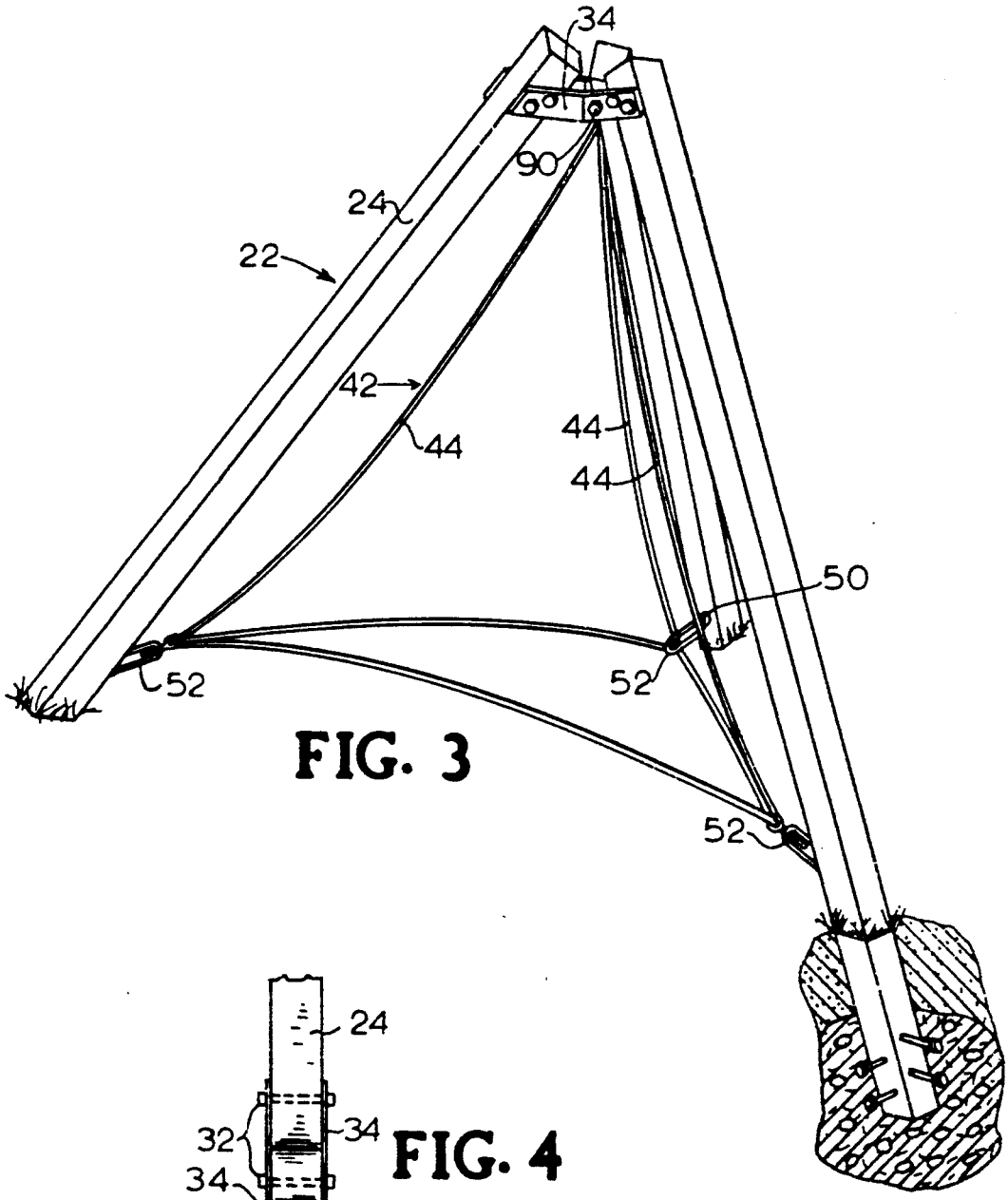
FIG. 3 is a perspective view of the tetrahedral structure of FIG. 1 without horizontal compressive beams.

The present invention provides a climbing and play structure 20 for placement on a surface 18 as shown in FIGS. 1–3 which is sturdy due to an outer rigid support structure 22, but which has a flexible inner network, and does not have inner rigid members for a child to strike. The outer rigid support structure 22 may be externally anchored as discussed below, but does not need to be anchored, and may serve as a portable play structure, so that it may be moved to make room for other activities, when it is placed, for example, in a small back yard.

The outer rigid support structure 22 of the climbing and play structure comprises outer rigid compressive members which form a polyhedron. The preferred outer polyhedral support structure is preferably in the form of a tetrahedron or a four-or five-sided pyramid. One of the sides of the polyhedral form is parallel to the support surface 18, while the remaining sides extend above the support surface 18. The external shape of a polyhedron is provided by compressive beams extending along either all of the edges of the polyhedron, or at least along the edges of the polyhedron which are not horizontal and are not along the surface 18 which supports structure 20. Most preferably structure 20 forms a tetrahedron having one point extending upward (FIGS. 1–3). The detailed structures of the preferred embodiment discussed herein are based primarily on the preferred tetrahedral structure, it being clear that use of the principles of basic geometry would allow appropriate adaptations of angles and the like for structures having more sides.

Preferably, the outer rigid compressive members comprise sloping compressive beams 24 and horizontal compressive beams 26 when the structure is situated so that it may need to be moved (FIG. 2). When the apparatus is situated in a permanent setting the horizontal compressive beams 26 may be omitted, and the sloping compressive beams 24 that extend generally upward can be extended, for example, approximately two feet below ground to anchor the structure as shown for one sloping compressive beam 24 in FIG. 3. The structure 20 may be anchored by being set in concrete. Because compressive forces tend to squeeze the members together and up out of the ground, these forces are preferably counteracted with anchoring concrete structures when the horizontal compressive beams 26 are omitted.

Nails, for example 4–6 16-penny nails per sloping compressive beam 24, are preferably pounded into the lower end of each beam 24 to assist in anchoring the beam 24 in the concrete. Holes can be dug for the lower (below-ground) extensions of the sloping compressive beams 24 so the horizontal compressive beams 26, which are temporarily clamped to the sloping compressive beams 24, are flush with the ground. The holes can then be filled with concrete to within about 6 inches of the ground surface with concrete as shown in FIG. 3. The holes should not be filled to the surface because if the dirt is worn away the concrete protruding above the surface may present a hazard. After the concrete hardens the horizontal compressive beams are removed.

The rigid compressive beams are preferably smooth rigid beams such as lumber 4×4's for the sloping compressive beams 24. Such heavy beams allow structure 20 to support any children and both the weight and tension of any interior structure from the upper vertex of the structure 20. The horizontal compressive beams 26 running along the ground, when present, are preferably much thinner than the sloping compressive beams 24 and may be made, for example, of 2×4's or stiff rods, since they are only needed to keep the sloping compressive beams 24 from pulling together at the base of the structure 20 when a load is applied to the inner rope structure. Any material that is used for the outer rigid compressive members should have a smooth surface. Thus, if lumber is used it should be sanded smooth so it will not splinter.

It is also important that the lower horizontal compressive beams 26 have as low a projecting profile as possible to minimize the likelihood of persons tripping on the horizontal compressive beams 26 or hurting themselves if they fall from the structure 20 on to the horizontal beams 26. Preferably the horizontal compressive beams 26 are set into the ground so their upper surface is flush with, or just below, the ground, and/or the horizontal compressive beams 26 are covered with resilient material to cushion any fall. If the resilient material is movable, it is important to replace or replenish the material if it is removed during play. Such resilient material may be wood chips, bark or sand, mats such as gymnast's mats, or a resilient foam pad 28. The latter allows the structure 20 to be easily moved and the resilient material to be placed back over the horizontal compressive beams 26, as well as allowing use of the structure 20 of the invention indoors. Alternatively, a foam pad 28 may be permanently attached to the horizontal compressive beams, which is particularly useful if the structure 20 is going to be moved often. A partial covering of foam is shown for illustration purposes in FIG. 2. Such a foam pad 28 preferably is wide enough and has tapered edges to cover the whole impact area around the horizontal compressive beams 26.

Figure 4:
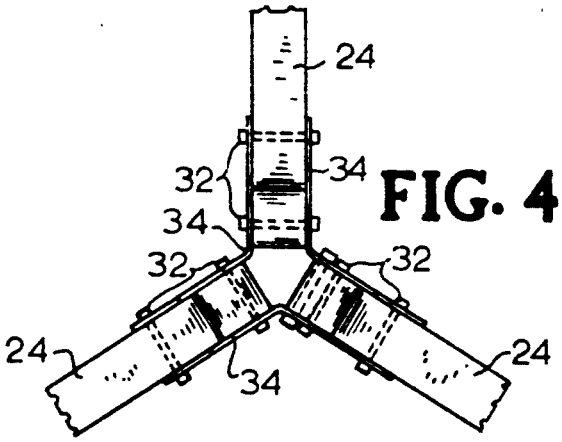
FIG. 4 is a top plan view of the upper end of joined sloping compressive beams of the structure of FIGS. 1–3.

For a tetrahedral structure, the sloping compressive beams 24 can be attached together at the top by means of bolts, and most preferably are attached by bolts and brackets as shown in FIG. 4. Care should be taken that the bolt ends do not protrude much past the nuts for safety so that children will not be injured by the sharp ends of the bolts. Locking nuts should be used in all instances so they cannot be tampered with or come loose. Bolts 32 having a diameter of ⅜ inch are preferably used for 10–16 foot structures, and care must be taken that the wood through which the bolts are placed is structurally intact.

The outer rigid compressive members are most preferably bolted together at the vertices with metal brackets 34 as shown in FIGS. 2–4. Brackets are preferred because they strengthen and reinforce the wood. When the brackets are used, ⅜" bolts with locking nuts can be used. Because the bolts clamp the brackets on both sides of the wood, the structure is much stronger using brackets. In addition, the preferred upper brackets 34 have a central hole 90 through which the network may be attached directly to the brackets 34 using a ½ inch bolt. One advantage of this means and location of attachment is that the bolts are away from the play area. The bolts at the apex are above the climbing area and are covered by cap 72 (see discussion below). The bolts for the lower brackets 36 are at or near ground level and are preferably protected by the resilient material. The attaching hardware (eye 50 and turnbuckle 52) is under the compressive beams 24 so children cannot fall on them. Nevertheless, care should be taken by persons using the structure of the invention.

As shown in FIG. 4, the top brackets 34 for a tetrahedral structure 20 preferably have a bend at a 120 degree angle and a cut edge at a 55 degree angle so a set of three brackets 34 holds the sloping compressive beams 24 in the proper orientation to each other without the brackets protruding beyond the edge of the lumber.

Figure 5:
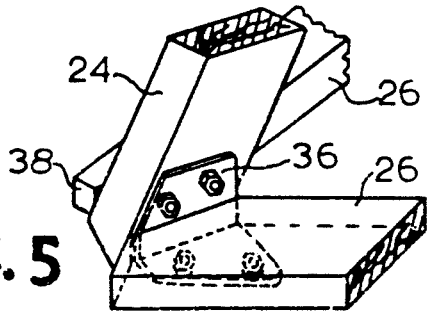
FIG. 5 is a fragmentary perspective view of the lower end of joined sloping compressive beams of the structure of FIG. 2.

As shown in FIGS. 2 and 5, the lower brackets 36 preferably are bent at a 90 degree angle and have a cut edge at a 37 degree angle. The ends of the horizontal compressive beams 26 are trimmed at 30 degrees as shown so they can rest horizontally on the ground and hold the sloping compressive beams 24 in the proper orientation by having the ends 38 of the horizontal compressive beams 26 butted against the angled lower ends of the sloping compressive beams 24. When the structure is permanently anchored to the ground in cement, the horizontal compressive beams 26 should temporarily be clamped into position at ground level to hold the structure 20 rigidly in proper alignment during installation.

Inside the outer rigid support structure 22 of each polyhedral climbing and play structure 20 of the invention is a primary inner network 42 made of primary flexible (rope-like) tensile members 44, with a primary tensile member 44 roughly paralleling each of the edges of the polyhedral form along the compressive beams 24, and along the compressive beams 26 (or where compressive beams 26 would be if present when they are omitted, FIG. 3) which form the edge of the polyhedral form (FIGS. 2 and 3). The term "roughly paralleling" and related terms as used herein mean that each primary tensile member 44 extends from at or near one end of a compressive beam 24,26 to near or at the other end of the same compressive beam 24,26, or where a compressive beam 26 would be located if not present, so that the primary inner network 42 is also in the form of a polyhedron, which, however will have irregular or segmented sides. The primary tensile member 44 which extends across the bottom of each side is preferably about two feet from the ground. Each primary tensile member 44 is slightly longer than the compressive beam 24 which it roughly parallels. Thus, in a tetrahedral structure there are six primary tensile members 44 which function as the corner edges of the primary inner network 42, each of which primary tensile members 44 runs roughly parallel to a sloping compressive beam 24 or to a horizontal compressive beam 26 (or to where a horizontal compressive beam would be attached if present).

Figure 6:
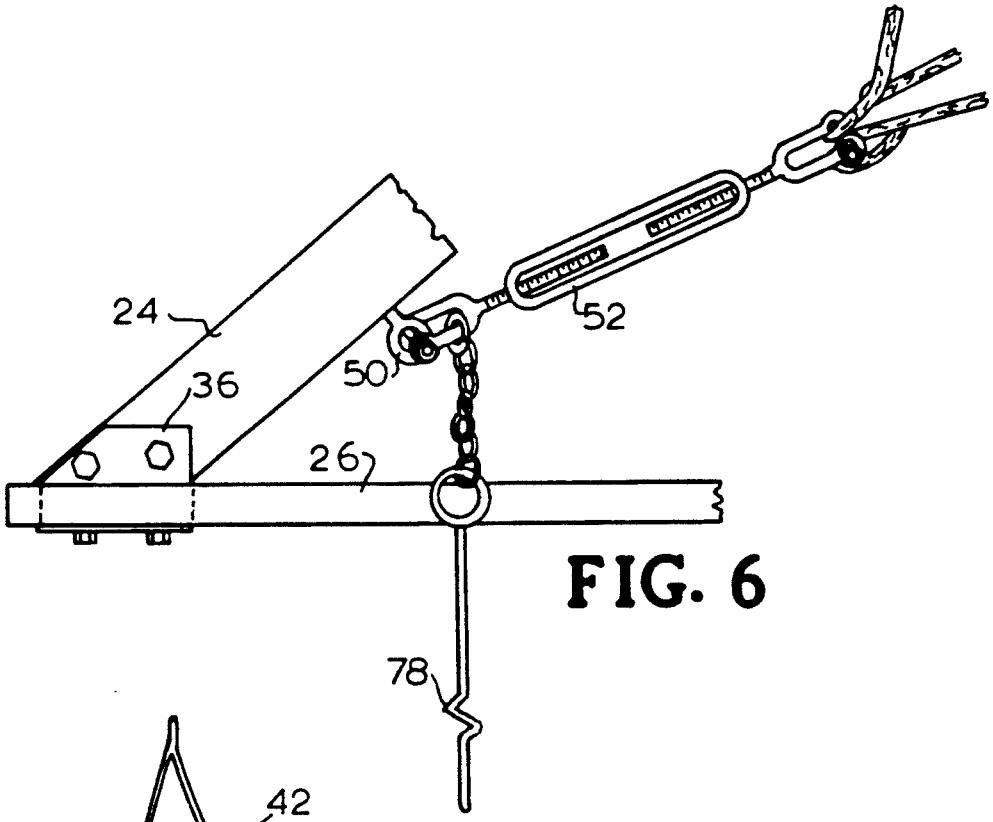
FIG. 6 is a side elevation view of a turnbuckle tension adjustment mechanism for primary tensile members.
Figure 19:
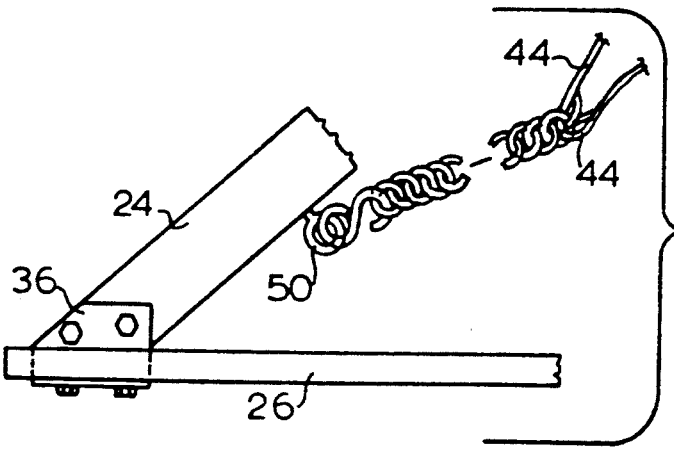
FIG. 19 is a side elevation view of a chain link tension adjustment mechanism for primary tensile members.

The primary inner network 42 formed of the primary tensile members 44 is attached to the outer rigid support structure 22 at the interior of the vertices 46A,B of the outer rigid support structure 22. As stated above, the upper corner of the primary inner network 42 may be attached to the central holes 90 of two of the three top brackets by means of a bolt between the primary hole 90 in two of the top brackets, or other means known in the art. Preferably, each of the vertical primary tensile members 44 is individually spliced around the bolt with the use of a thimble (FIG. 12A, discussed below) to maximize the strength of the material of the primary inner network 42 and minimize wear on the tensile members. The means of attachment of the primary inner network 42 to the structure at the lower vertices preferably comprises a turnbuckle 52 or other analogous tensioning device (FIG. 6) which is most preferably used on the three lower vertices, but is important to be used on at least one vertex so that the primary inner network 42 can be properly tensioned. The turnbuckle 52, preferably at least ⅜ inch diameter with 6-inch take-up, attaches to an eye 50 (FIG. 6) placed in the inside of a sloping compressive beam 24. The eye 50 should not open under load, and is for example, a forged eye (⅜"×2½", stock #41392) available from Edward W Daniel Co. (Cleveland, Ohio). Alternatively, a chain can be used in place of one or two turnbuckles. When only one turnbuckle is to be used, pieces of chain can be substituted for the turnbuckles at one or two of the lower corners (see FIG. 19). The chain must be of sufficient size that the tensile members can be spliced or otherwise connected to the chain's links. A 12–18 inch piece of galvanized 5/0 chain is suitable for this purpose, attached to a heavy-duty S-hook made of at least about ½" diameter wire. When chain is used in place of some of the turnbuckles, first the turnbuckle(s) are attached fully extended, and then the chains are evenly tensioned and attached as tightly as possible to the eyes at the respective vertices. Finally, the turnbuckle is tightened. As the tensile members stretch with use, the turnbuckle is tightened to its limit. If further tightening becomes necessary, then the turnbuckle is extended, the chains are moved tighter and the turnbuckle is tightened. Although use of chains is more difficult than use of turnbuckles, it allows a reduction in cost of the invention.

Figure 7:
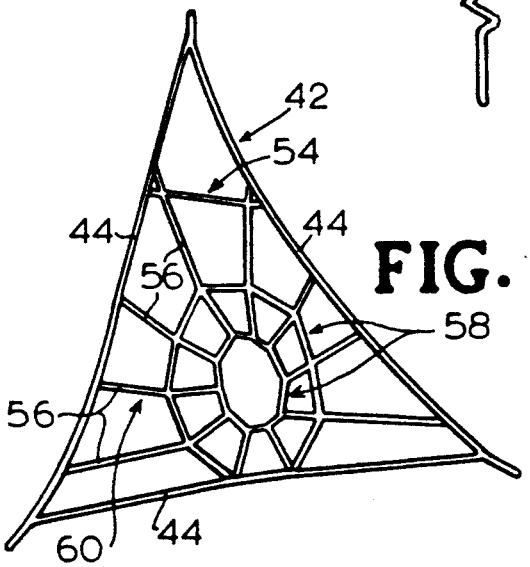
FIG. 7 is a perspective view of a spider web form of secondary tensile members which may be used on the face of a primary inner network.
Figure 8:
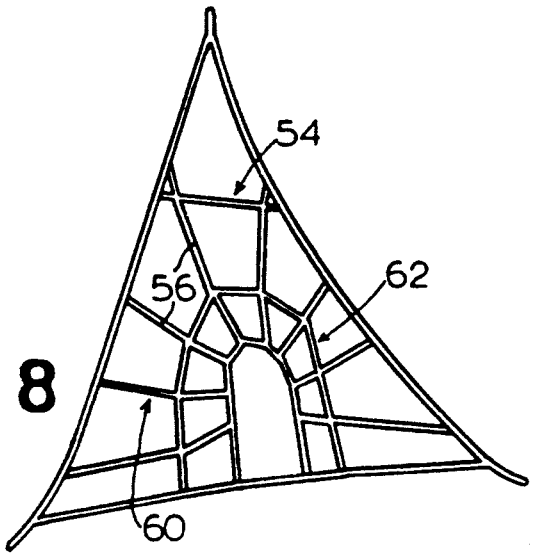
FIG. 8 is a perspective view of an arch form of secondary tensile members which may be used on the face of a primary inner network.
Figure 9:
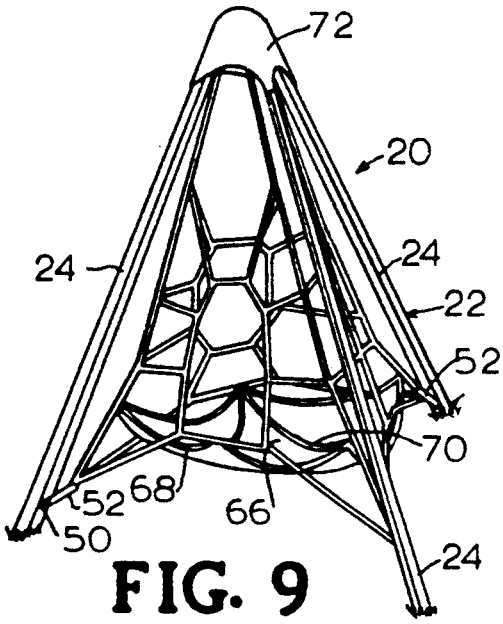
FIG. 9 is a perspective view of the structure of the invention which has an interior flexible planar surface.

A secondary inner network 54 of secondary flexible tensile members 56 (FIGS. 1 and 7–9) can be attached to the primary tensile members 44 to construct a network generally along the faces of the tetrahedron formed by the primary inner network 42 in a variety of patterns to create an appealing form (FIGS. 714 8). As used herein the term "face" of the primary network means the lateral side of the polyhedron which is formed by any three primary tensile members 44. Generally, the bottom side of the polyhedron, as discussed below, is spanned by a flexible planar surface 66 and not a secondary network. Thus, for the tetrahedral structure shown in the figures, there typically may be one to three faces along which secondary inner networks 54 may be constructed.

The secondary inner network 54 thus comprises one or more generally planar patterns, each of which is attached to the face formed by the primary inner network 42 when said primary inner network 42 is attached to said outer rigid support structure 22. It is desirable that the secondary tensile members 56 used to construct the faces of the primary inner network 42 be attached to the primary tensile members 44 at roughly regular intervals, because the tension of the tensile members on the faces that draws the edge of the primary inner network 42 formed by the primary tensile members 44 into graceful segmented curves with such evenly spaced attachment. It is important to take care so that the polygons formed by the primary and secondary tensile members 44, 56 are of sufficient size so that children are not likely to be entrapped when climbing in and through the structure 20. Thus, it is important to comply with appropriate voluntary standards, for example, F1148-91, the Standard Consumer Safety Performance Specifications for Home Playground Equipment.

A first preferred pattern of secondary tensile members 56 on the face of the primary inner network 42 is a spider web of concentric polygons 58 with radial spokes 60 emanating from the central polygon 58 and distributing the load from the polygons 58 to the primary tensile members 44 (FIG. 7). A second preferred structure is an arch 62 or group of concentric arches 62 with radial spokes 60 distributing the load from the arch 62 to the primary tensile members 44 (FIG. 8). Such a structure provides an easy entry into the primary inner network 42. The radial spokes 60 that help define the arch 62 can meet the primary tensile members 44 at the same locations as the radial spokes 60 from the spider web if the two patterns are used on adjacent faces.

Depending on the size of the structure, additional tensile members (not shown) may extend into or through the network, so long as the movement of children in the structure 20 is not undesirably impeded.

The tensile members used in the invention are preferably ropes or rope-like members which are selected for strength, weather resistance, durability, soft feel, and easy splicing. Rope which has been found to be suitable for tensile members for residential use where vandalism is not anticipated is ½" EASYSPLICE TM hollow braided polyester rope (Wellington Puritan, Madison, Ga.). For public playgrounds, where vandalism is expected, rubber or fiber covered cable or chain is preferred. Because the structure 20 is generally located outside and is likely to be exposed to weather extremes of moisture and temperature, and because the structure 20 is likely to receive substantial, vigorous use, it is important that owners of the structure inspect the structure 20 regularly, particularly the tensile members, for wear or decay or deterioration, so that damaged portions may be removed and replaced.

Figure 14:
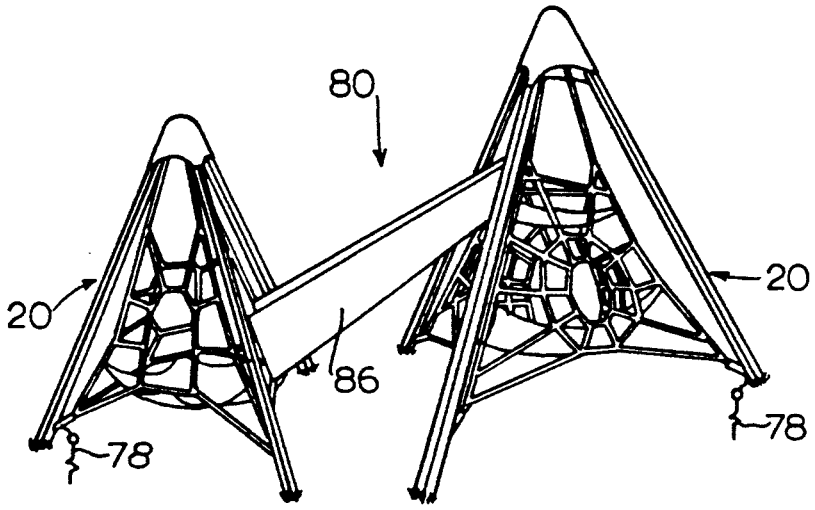
FIG. 14 is a perspective view of multiple structures connected together with a flexible U-shaped surface between tensile networks.
Figure 15:
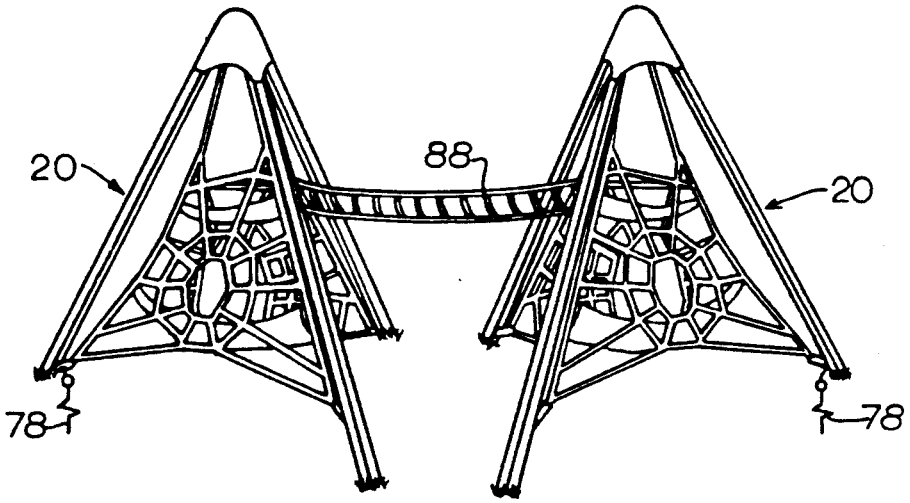
FIG. 15 is a perspective view of multiple structures connected together with a bridge.
Figure 16:
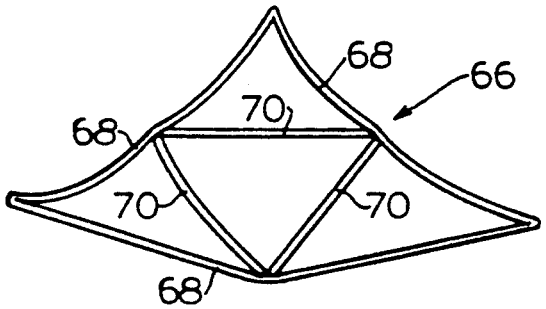
FIG. 16 is a perspective upper view of a flexible planar surface for use in the interior of a tetrahedral structure according to the invention.

Load-bearing flexible planar surfaces 66 in a variety of shapes, for example, a triangle as shown in FIG. 16, can define horizontal or inclined planes within the structure 20, and can be attached to the primary tensile members 44 and/or the secondary tensile members 56 (FIGS. 1, 9, and 14–15). When the load-bearing flexible planar surfaces 66 are attached to the secondary inner network 54 so that the load is transferred to the primary tensile members 44 by secondary tensile members 56 that are angled and not vertical, as shown, for example in FIGS. 14–15, a bouncy platform is created that derives resiliency independently of the elasticity of the material from which the tensile members 44,56 are constructed. The resiliency is created by deformation of the polyhedral shapes that exist when there is no load on the network. Climbing or bouncing on any one of the tensile members 44,56 causes movement throughout the primary and secondary inner networks 42, 54 and causes bouncing of a person on flexible planar surface 66 such as a fabric platform. In addition, horizontal flexible planar surfaces 66 provide a comfortable hammock for children and adults.

The load-bearing flexible planar surfaces 66 are preferably made of durable fabric such as TEXALENE TM (distributed by Unitex, Fort Lauderdale, Fla.) which is a fine mesh nylon coated with PVC plastic so water will not puddle on the planar surfaces 66. As shown in FIG. 16, the flexible planar surfaces 66 may be reinforced along their edges 68 and along their primary load bearing lines 70 (for example, between attachment points of the flexible planar members 66 to the tensile members 44,56) with polyester, nylon or other suitable webbing.

Figure 10:
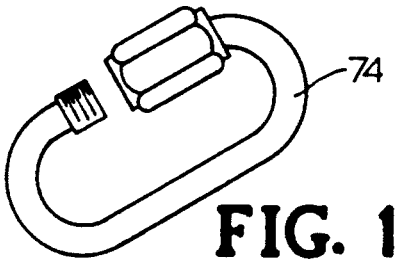
FIG. 10 is a perspective view of a chain link which may be used for attaching a flexible planar surface to a tensile member.

The flexible planar surfaces 66 may be attached to the tensile members 44,56 by splicing the flexible planar surfaces 66 directly to the tensile members 44,56. Alternatively, the flexible planar surfaces 66 may be attached to the tensile members 44,56 using "S"-shaped hooks (shown for another use attached to eye 50 in FIG. 19), or most preferably, using removable chain links 74 (FIG. 10). If S-hooks are used, the end of each hook which attaches to the flexible planar surface 66 should be bent closed at both ends (around the web-enforced edge 68 of the flexible planar surface 66 and around the tensile members 44,56) so that clothing or drawstrings will not become entangled. Removable links 74 are preferred, particularly if changes or repairs to the networks are anticipated. S-hooks are more permanent to discourage theft. Direct ties are cleanest but most difficult to repair or change.

To protect the horizontal primary tensile members 44 from abrasion at the connection points with the planar surface 66, it is preferred to splice a loop of tensile material to the primary network 42 and then attach the links to the loops so the primary tensile members 44 do not wear from abrasion with the links. On the vertical primary tensile members 44, the links should be free to slide along the primary tensile members 44 which allows the planar surface 66 to adjust to different tensioning situations. Thus, the wear is not always in the same plane or at the same point on the vertical tensile members 44.

Figure 11:
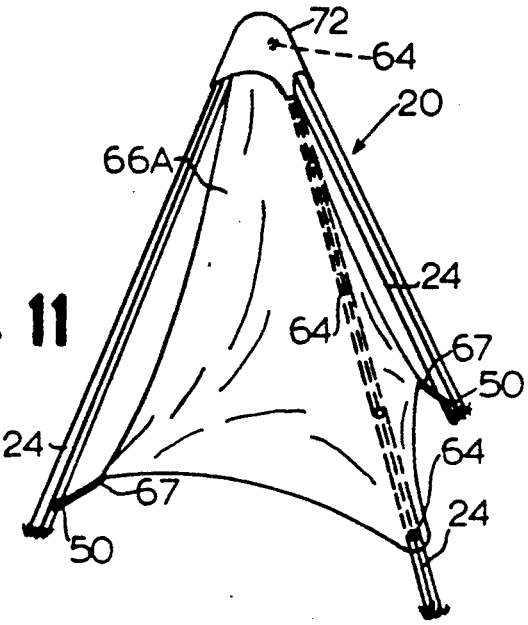
FIG. 11 is a perspective view of an external flexible planar surface attached to the outer rigid support structure.

Flexible planar surfaces 66A may also be attached directly to the outer rigid support structure 22 along one or more outer faces of the structure 20 between sloping compressive beams 24, to create an interior environment around the primary and secondary inner networks 42, 54, to increase the imaginative play value of the structure, to provide privacy, and to shade the structure to protect the children playing in the structure from the sun (FIG. 11). Such outer flexible planar surfaces 66A may be attached at the vertices 46 of the outer rigid support structure 22 and/or may be attached, for example, to the exterior side of the sloping compressive beams 24. Planar surfaces 66A are preferably made of fabric to match the planar surfaces 66 and/or of waterproof fabric. When present, such planar surfaces 66A preferably cover two of the faces of the structure 20. A planar surface 66A can be attached to the compressive beams 24 with a row of snaps 64 along a central line on the planar surface 66A, and then can be stretched into position using a shock cord 67 attached between eye bolt 50 and the respective lower corner of the planar surface 66A (FIG. 11). Preferably the edges of the planar surface 66A are in the shape of a concave catenary curve so the tension will hold the edges taut and they will not flap in the wind.

Figure 17:
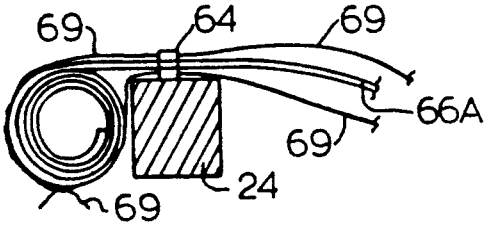
FIG. 17 is a partial cross-sectional view of a means of attachment of the flexible planar surface of FIG. 11 to a sloping compressive beam.

A tie 69 may also be provided both on the inside and outside of the planar surface 66A and near the center of the planar surface 66A so that either or both sides of the planar surface 66A can be rolled out of the way (toward the compressive beam 24 to which the planar surface 66A is attached) as illustrated with one side tied up in FIG. 17.

Preferably the tensile members 44,56 are connected to each other or to other components of the structure 20 by splices 76 (A-C). When a soft hollow braid rope is used, three kinds of attachment splices provide the preferred connections (FIG. 12 A-C). To support the load at the top (interior of vertex 46A), preferably a running Brummel splice 76A is used around a protective thimble (FIG. 12A). Special care is taken at this vertex because this is the area of maximum load, and a failure at this vertex will allow the primary and secondary networks to collapse. Where two ropes cross each other, a running splice 76B can be used (FIG. 12B). Where a rope ends at a vertex or at another rope, a lock splice 76C may be used (FIG. 12C). When chain is used instead of rope, removable links are preferably used to make the connections. When cable is used, smooth clamps or swages should be used.

When the primary tensile members 44 are connected together and to the secondary inner network 54 of secondary tensile members 56 and are under tension, a curved polyhedral inner network is formed by the primary tensile members which reflects the polyhedral form of the outer rigid support structure 22, but which is curved inward from the outer rigid support structure 22 (FIGS. 1, 9 and 13–15). This discourages children from climbing on the surface of the outer rigid support structure 22 and, for the most part, away from the outer rigid support structure 22. These primary tensile members 44 ultimately take all of the load and must be suitably strong.

A plurality of the rigid support structures 20 may be joined together to form a more complicated play and climbing structure 80, as shown for example in FIGS. 13–15. Thus, as shown in FIG. 13, each of two rigid support structures 20 may be positioned, preferably with selected flat faces facing each other, and at the upper vertex 46A of each structure 20, an upper horizontal beam 82 can be attached to the opposing sloping compressive beam 24, above the bracket to one extended sloping compressive beam 24 (FIG. 18) to attach the adjacent structures 20 together. Another way is to attach the horizontal beam 82 directly to the sloping compressive beam 24 below the top bracket. In addition, additional play elements, for example swings 84 and other types of climbing elements, such as climbing ropes, rings, and the like (not shown), may be attached to this upper horizontal beam 82.

Figure 18:
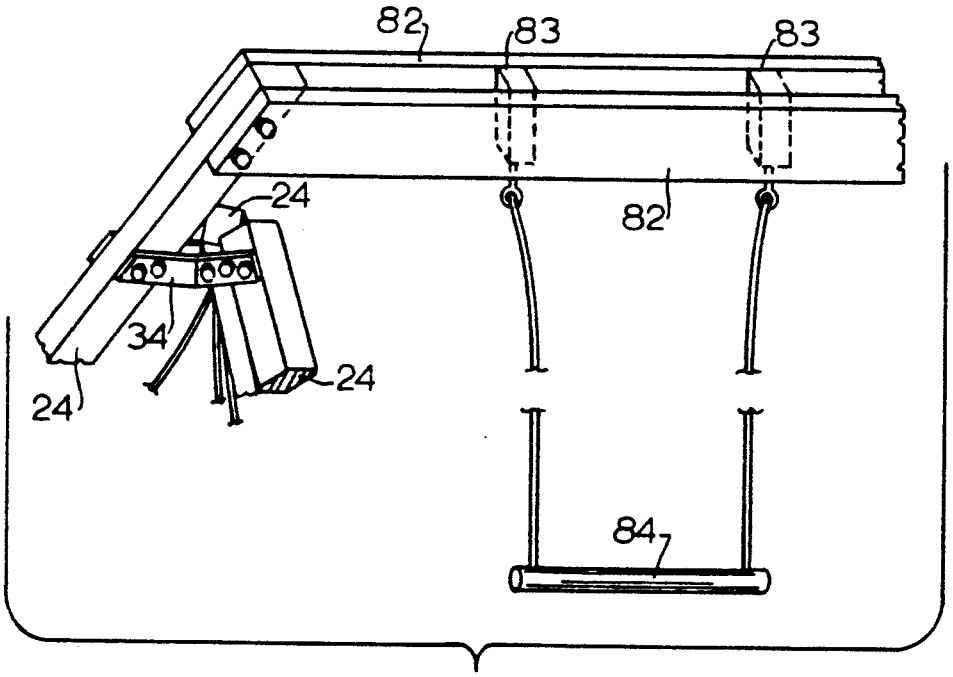
FIG. 18 is a partial perspective view of the upper beam structure of FIG. 13.

Care should be taken that the horizontal beam 82 is long enough that there is proper clearance for the swinging elements and for the base of the structure so that children using the structure 20 will not be in the path of the swings. To make the beam 82 long enough and keep it rigid, a 2"×10" beam structure can be constructed with 4"×4" spacers 83 as shown in FIG. 18. Standard construction methods should be used to carry the estimated loads of a minimum of 150 pounds per swing position as set forth in ASTM F1148-91 referred to above.

Structures 20 may also be joined together by their flexible inner networks using the same methods of connection used to connect the tensile members of the inner and outer networks. Such joining may be multilevel and fabric panels can serve as a slide 20 from an upper part of one structure 20 to a lower flexible planar surface 66 of another structure 20 as shown in FIG. 14. Such joining may be at the same or a different level in two adjacent structures 20 forming bridges 88 which can be made of rope, fabric and/or stiff slats (FIGS. 14–15). Slides should be made of a smooth fabric, for example, of HERCULITE L25-2 TM (Herculite Products Inc., York, Pa.). The fabric may be lubricated with a non-toxic silicone lubricant.

When the slides 86 or bridge elements 88 are attached, care must be taken that no entrapment openings are created, particularly where the edge of the slide or bridge panel runs parallel to tensile members of an existing network. Where that happens, chain links can be used to secure the edge of the panel to the tensile member so the openings are too small for entrapment to occur.

Where the lower end of the slide joins the lower deck (planar surface) of a second structure 20, a lip (not shown) should cover any opening, attachment splices or hardware, so that children will slide directly from the slide to the bouncy platform. The sides of the slides 86 should be high enough to prevent children from falling out of the slide. When two structures 20 are attached by means of a flexible structure, the ends of the units need to be staked to the ground as shown in FIGS. 14–15 so the structures 20 do not rock up from the external weight of the slide and child. Ground anchors 78 made by Hedstrom Co. (Bedford, Pa.) are useful for such anchoring.

Structure 20 may be made in any size appropriate for the yard or play space, but preferably, for a tetrahedral structure, the compressive beams 24,26 are about 10 to about 16 feet long.

Preferably the structure 20 is assembled at the site where it will be used to avoid long-distance moving of the assembled structure 20. In the preferred process of assembly the structural components are placed on level ground, preferably not less than six feet from any structure or obstruction such as a fence, garage, house, overhanging branches, laundry lines or electrical wires. The surface 18 on which the structure is installed should not be concrete, asphalt, packed earth or any other hard surface, so that serious injury from a fall may be avoided.

The climbing and play structure 20 of the invention is preferably assembled by taking appropriate length sloping compressive beams 24 and first attaching them loosely together with only one bolt per member in the appropriately drilled holes of the upper brackets 34 so the member can rotate around that point. The pre-assembled inner network is also attached to the bracket as described above. The three sloping compressive beams 24 may then be placed in upright position on a surface 18. The turnbuckles 52, attached to the preassembled networks, are extended to the their maximum length and are attached to the eyes 50, and the sloping compressive beams 24 are then extended until the attached networks are tight. The horizontal compressive beams 26 are placed between the bottoms of the sloping compressive beams 24, and bolted loosely or clamped (if the structure is to be set in concrete) to the sloping compressive beams 24 with the brackets 36, bolts and lock nuts or clamps. The entire structure 20 is then placed on one side so that the rest of the upper bolts may be placed through the brackets 34 into holes in the compressive beams 24. The bolts on the upper vertex 46A may then be tightened, making sure that the bolts used are long enough to reach the end of the nuts, but do not protrude substantially (more than about ¼"). If the bolts are too long they should be cut or filed off, or washers used so there are no exposed threads or sharp edges.

A cap 72 is preferably placed over the upper vertex 46A. The cap 72 is preferably a single piece of matching material (to the planar surfaces 66) which has been formed into a tetrahedral shape to fit over the upper end of the structure 20 and serves to enhance the appearance of the structure 20. The cap 72 is preferably screwed to the sloping compressive beams 24 by screws through the fabric. Cap 72 may be lengthened as shown on the right structure 20 of FIG. 13 and may have windows 73 of transparent plastic material. One or more zippers, snaps, ties or the like may be used on cap 72 or on the windows 73 so that children can open and close the tent formed by the cap 72.

The structure is then tipped upright. The bolts at the remaining vertices 46 are tightened, again following the above-discussed precautions regarding bolt lengths, or the ends are set in concrete and the clamps removed when set.

The planar surfaces 66 are pre-attached to the network. If not pre-attached, the planar surfaces 66 are then attached to the appropriate tensile members, preferably with chain links 74. Finally, the turnbuckles 52 are tightened evenly until the net is tight enough so that children may play on any lower planar surface 66 without touching the ground. Slides 86 and bridges 88 are optionally attached in a similar manner as the planar surfaces to the desired levels of the networks, taking care that there are no large gaps through which a child might fall or be caught.

Particularly when two or more structures 20 are used, corners of the structure 20 which have particular stress, such as the corner opposite a slide 86 should have additional anchoring. To temporarily hold the structure(s) in position, weights, for example, two 80-lb bags of sand, may be placed on each horizontal compressive beam 26 adjacent to each sloping compressive beams 24. For a semi-permanent installation, steel ground anchors, such as anchoring spikes 78, for example 12 inches long with 1 inch wide screw flanges are first screwed into the ground, and then attached to structure 20 using a chain link or turnbuckle. Use of such spikes is not necessary if the structure is anchored in concrete as described herein.

Finally, the chosen resilient material is placed over the horizontal beams and adjacent ground surface. When assembled, a 10-foot tetrahedral single deck, for example, is designed for use by up to three children weighing up to 75 pounds each. A 14-foot tetrahedral double deck, for example, is designed for use by up to five children weighing up to 75 pounds each.

After assembly, it is important to monitor the structure's tensile structures and planar surfaces for wear and deterioration, and to check the nuts and bolts for tightness. Thus, the stitching on planar surfaces 66 may become worn with use resulting in loose webbing. When adjacent bundles of fibers on the horizontal tensile members are worn, the tensile members should be replaced. When any of the three sloping tensile members of the primary network is worn, the network should be replaced. Periodic tightening of the turnbuckles compensates for any stretching of the tensile members or planar surfaces. Such adjustment of the turnbuckles and nuts and bolts is particularly important during the first season of use as the materials stretch, and at the beginning of each new season of use. The structure may be cleaned with soap and water and rinsed using a hose, but it is important not to use harmful or abrasive cleaners which may damage portions of the structure or present problems for later users of the structure.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A climbing and play structure, (a) a support surface on which said climbing and play structure is placed;

(b) an outer rigid support structure comprising sloping compressive beams and having lower vertices between said sloping compressive beams and said support surface, and an upper vertex formed where the upper ends of at least three sloping compressive beams slope toward a single point and are joined to each other, said outer rigid support structure forming a polyhedral shape;

(c) a primary inner network comprising primary tensile members roughly paralleling said sloping compressive beams and said support surface, each of said primary tensile members being connected to other tensile members at the interior of said vertices, wherein at least three primary tensile members are connected to each other at the interior of said upper vertex, said primary inner network forming faces along sides of said network between said primary tensile members; and (d) a secondary inner network comprising secondary tensile members forming a pattern on one or more of said faces.

2. A climbing and play structure according to claim 1, further comprising horizontal compressive beams extending along said support surface between said sloping compressive beams.

3. A climbing and play structure according to claim 2, wherein said horizontal compressive beams are covered with a resilient material.

4. A climbing and play structure according to claim 1, further comprising a flexible planar surface attached to said sloping compressive beams.

5. A climbing and play structure according to claim 1, wherein said support surface is an outside earth surface, and said sloping compressive beams are anchored to the earth surface so that the sloping compressive beams extend into the earth.

6. A climbing and play structure according to claim 1, further comprising a load-bearing flexible planar surface within said primary inner network having corners which are attached to said tensile members so that said flexible planar surface is suspended beneath said upper vertex.

7. A climbing and play structure according to claim 7, wherein said flexible planar surface has peripherally attached webbing.

8. A climbing and play structure according to claim 6, wherein webbing is attached to said flexible planar surface between points on said flexible planar surface where said flexible planar surface is attached to said tensile members.

9. A climbing and play structure according to claim 1, wherein said polyhedral shape is a tetrahedron.

10. A climbing and play structure according to claim 1, wherein said secondary liner network forms a pattern selected from the group consisting of a spider web pattern, consisting essentially of concentric polygons with radial spokes emanating from the central polygon, and an arch pattern.

11. A climbing and play structure according to claim 1, wherein said structure is attached to a second climbing and play structure.

12. A climbing and play structure according to claim 11, wherein said structures are attached by means of an upper horizontal beam extending between upper vertices of said structures.

13. A climbing and play structure according to claim 11, wherein said structures are attached by means of a slide or bridge extending between tensile members of said structure and said second structure.

14. A climbing and play structure according to claim 13, wherein said slide or bridge is a flexible planar surface.

15. A climbing and play structure according to claim 13, wherein said bridge is a rope structure.

* * * * *